United States Patent [19]

Shelley

[11] 4,011,394

[45] Mar. 8, 1977

[54] KILNS

[76] Inventor: Donald Percy Shelley, Oulton Grange, Oulton near Stone, England

[22] Filed: July 9, 1975

[21] Appl. No.: 594,524

[30] Foreign Application Priority Data

July 16, 1974 United Kingdom ..... 31533/74

[52] U.S. Cl. ..... 13/20; 13/25; 110/1 A; 219/390; 432/247

[51] Int. Cl.[2] ..... H05B 3/16

[58] Field of Search ..... 13/20, 22, 25, 35; 219/390; 110/1 A; 432/247

[56] References Cited

UNITED STATES PATENTS

| | | | |
|---|---|---|---|
| 1,709,350 | 4/1925 | Jackman | 110/1 A X |
| 3,368,802 | 2/1968 | Morgan et al. | 110/1 A X |
| 3,705,253 | 12/1972 | Hicks | 13/20 |
| 3,909,907 | 10/1975 | Davis | 110/1 A X |

*Primary Examiner*—R. N. Envall, Jr.
*Attorney, Agent, or Firm*—Marshall & Yeasting

[57] ABSTRACT

A set of components for use in the construction of a kiln comprising a number of holding devices adapted to be mounted on the outside of a kiln, a number of tie bars engageable in the holding devices so that the tie bars project into the kiln through the insulated walls thereof, and slabs or sheets of lightweight lining material adapted to be supported by the tie bars at the inner surface of the kiln wall.

4 Claims, 3 Drawing Figures

KILNS

This invention relates to kilns and more especially to the construction of the kilns and to components for use in such constructions. The invention is particularly suitable for ceramic kilns but it is not restricted to these; for example it may also be used in connection with metal heating furnaces.

Typical kiln construction systems employ linings of refractory insulation bricks or firebricks but in the design of intermittent kilns considerable benefits are obtained from the use of lightweight linings such as ceramic fibre materials, due to the lower mass of material to be heated and hence economy in fuel. The thermal conductivity of ceramic fibre materials is also usually less than that of refractory insulation bricks or firebricks.

In kilns and furnaces for use at high temperature (typically 1000°–1350° C), such as are used for example in the ceramic industries in the biscuit and glost firing of earthenware, bone china and the once-firing of sanitary ware and electrical porcelain, there is, in some circumstances, a gradual erosion or denaturing of the fibre lining causing material to fall away from the surface; in the case of glazed ware firing, spoiling of the glaze is caused, and in all cases the life and efficiency of the material is reduced. The breakdown of the material is more rapid in kilns fired by high velocity gas or oil burners which are often technically desirable to improve the temperature uniformity of the kiln.

The breakdown is also hastened by corrosive gases from the ware being fired, which may react with the fibre material. Volatile lead and borax compounds in ceramic glazes cause the kiln atmosphere to be rich in these materials and some ceramic bodies emit fluorine compounds at high temperatures.

In electrically heated kilns it is desirable to be able to fit the electric heating elements in various positions to obtain the necessary temperature uniformity and most metal heating elements, either of coiled wire or formed from tape, are preferably supported in horizontal refractory troughs as they are very weak and prone to deform at high temperature. It has been the usual practice in the past to support these elements on insulating brick shelves or troughs forming part of the kiln wall or on refractory channels or rods which are supported by pillars of insulating brick in the kiln wall and are interspersed with ceramic fibre insulation.

The present invention consists in a construction system by which inwardly extending support ties are located and secured in position in holding devices on the outside of the kiln, the support ties being arranged so as to carry ceramic fibre or like lightweight lining material on the inside of the kiln.

In electrically heated kilns the support ties are so formed at their inner end regions as to receive and support heating element carrier members which help also to hold the ceramic fibre or other lining material in position.

The support ties may also carry tiles of ceramic material covering the inner surface of the ceramic fibre or other lining material in order to protect it from the kiln atmosphere; the tiles are particularly useful in the case of gas- or oil-fired kilns but they may also be used in conjunction with the electrical heating element carrier members.

In a preferred arrangement the support ties are in the form of bars of refractory material whose outer ends are clamped and secured in the holding devices by means of pegs passed through holes in the support ties and holding devices so that the support ties extend inwardly through the kiln wall casing or roof and the lining material, the units of lining material (and the tiles and element carriers where provided), bearing on the support ties, whose effective length is determined by selection of the appropriate hole for receiving the peg in the holding device.

Constructional forms of the invention will now be described with reference to the accompanying drawings, in which.

Figure 1:
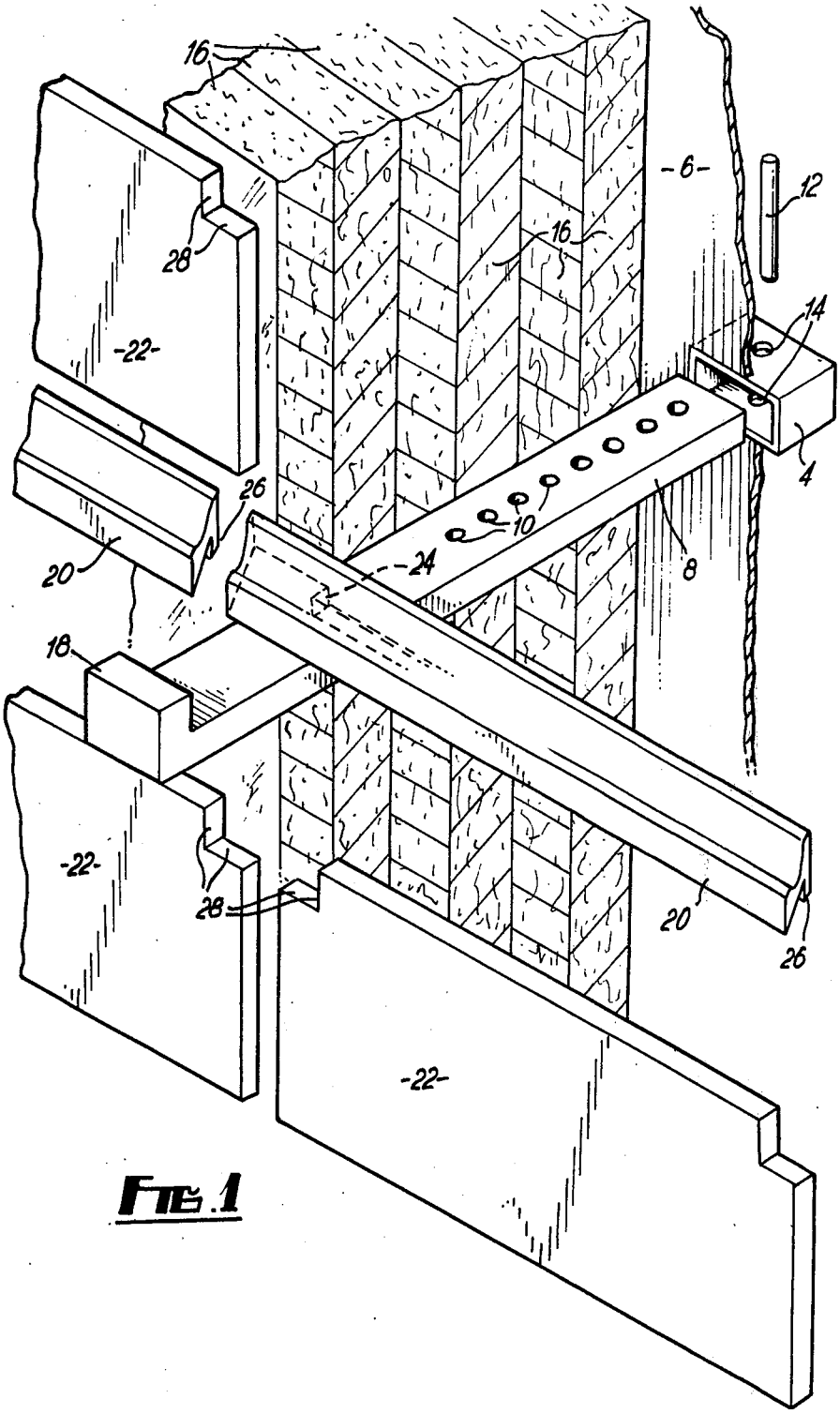
FIG. 1 is an exploded perspective view of the components involved in the construction of a portion of a kiln wall.

Referring to FIG. 1 a holding device 4 is fitted on the outside face of the kiln casing or shell 6 and is shaped to receive the outer end region of a support tie bar 8. As shown the bar 8 is of rectangular cross-section and the holding device 4 is of similar shape to receive it. A number of holes 10 are provided in the bar 8 and the bar is secured in the holding device by driving a peg 12 through holes 14 in the holding device and through a selected hole in the bar, the latter being chosen so that the bar will project inwardly to the desired length; any surplus length of the bar at the outer end may be cut off. The bar passes through and supports slabs or sheets of ceramic fibre or similar lining material 16 and its inner end is formed with an upstanding lug 18 by means of which heating element carriers in the form of elongated troughs or channels 20 are retained in position. Tiles 22 are also supported by the bars 8 between the element carriers 20 and the lining 16, the tiles being shaped to fit around or between the bars 8. Thus it will be seen that the bars 8 are firmly located in position by the holding devices 4 and the lining is likewise clamped between the tiles 22 and the casing 6 with the help of the troughs or channels 20, which are formed with stepped shoulders 24 abutting against the sides of the bars 8 at their joints one with another. The meeting faces at the ends of the lengths of the troughs or channels are inclined rather than square so that the heating elements are unlikely to work down into the joint. The cross-sectional form of the troughs or channels includes a depending rear portion 26 which in use abuts against the face of the tiles. The corners of the tiles are cut away at 28, or the tiles have holes through them, to enable the bars 8 to pass through.

Figure 2:
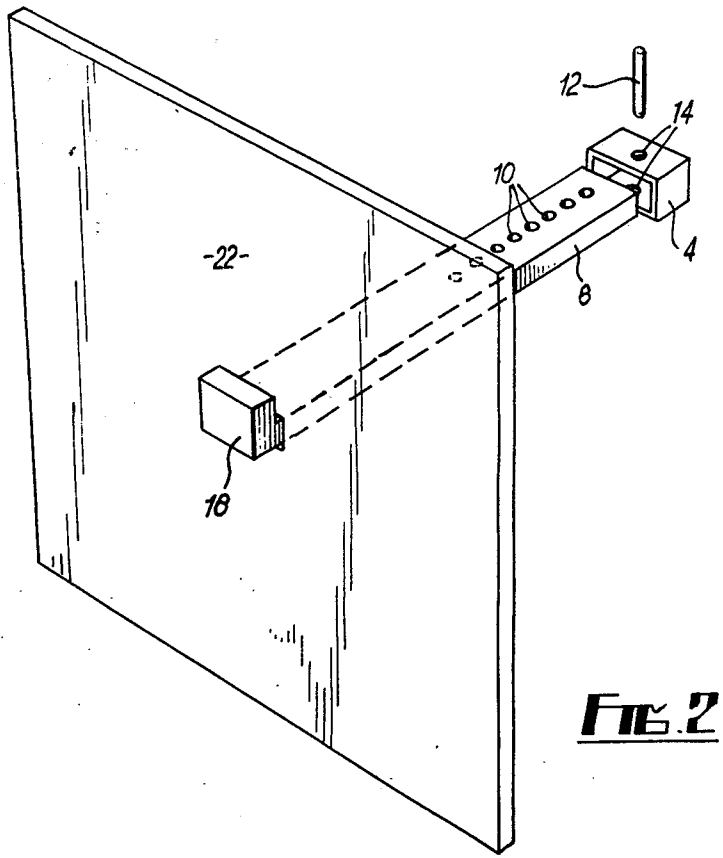
FIG. 2 is a similar view showing an alternative arrangement.

FIG. 2 shows a similar arrangement but omitting the electrical element troughs or channels 20, for positions in a kiln where there are no such elements or in gas- or oil-fired kilns.

Figure 3:
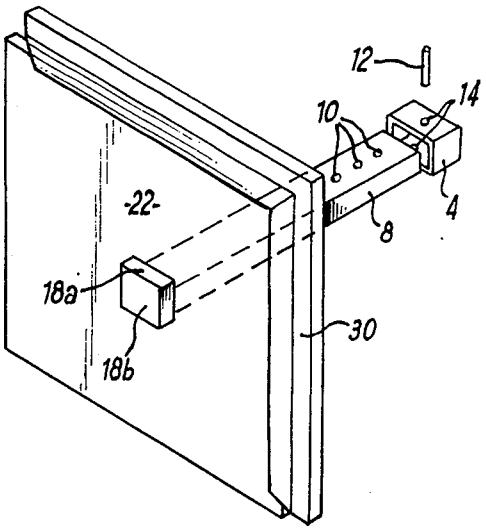
FIG. 3 is a similar view to a reduced scale illustrating a modification.

FIG. 3 shows a modification in which the tiles 22 are formed with a rebated or overlapping portion along their edges as indicated at 30 to provide additional protection for the lining. In addition the inner end of the bar 8 is provided with upwardly and downwardly projecting lugs **18*a*, 18*b* instead of a single lug 18 as in FIGS. 1 and 2.**

It will be appreciated that by this invention a small number of standardised components can be designed and supplied for use with electrical, gas- or oil-fired kilns of various wall or roof thicknesses with or without element carriers or protective tiles as the case may demand and the various components can be easily assembled and installed or removed and replaced (as when suffering from damage or chemical deterioration) without requiring highly skilled labour. The construction further provides for a lower weight of refractory materials than conventional arrangements.

The invention also comprises sets of component parts as herein described for assembly in kiln construction.

Various modifications may be made without departing from the scope of the invention for example it will be evident that the shape of the components may differ considerably if required.

I claim:

1. A kiln in which inwardly extending cantilevered support ties are located and secured in position in holding devices on the outside of the kiln, the support ties being arranged so as to carry ceramic fibre or like lightweight lining material on the inside of the kiln and being in the form of bars of refractory material.

2. A kiln as claimed in claim 1, in which the outer ends of the refractory support ties are clamped and secured in the holding devices by means of pegs passed through holes in the bars and in the holding devices so that the support ties extend inwardly through the kiln wall and the lining material for a distance determined by selection of the appropriate hole for receiving the peg in the holding device, the units of lining material bearing on the support ties.

3. A kiln as claimed in claim 1, having electrical heating means in which the support ties are formed at their inner end with upstanding lugs by means of which continuous electrical heating element carriers are retained in position, said heating element carriers being in the form of a plurality of elongated troughs or channels in abutting end-to-end relationship and having stepped shoulders at their ends.

4. A kiln as claimed in claim 3, in which the cross-sectional form of the heating element carriers includes a depending rear portion adapted to abut against the faces of the ceramic fibre or other lining material.

* * * * *